US006860051B2

(12) United States Patent
Knauf

(10) Patent No.: US 6,860,051 B2
(45) Date of Patent: Mar. 1, 2005

(54) DISPLAY DEVICE FOR AN OBJECT

(75) Inventor: Kenneth J. Knauf, Marietta, GA (US)

(73) Assignee: Knauf & Associates, Marietta, GA (US)

( * ) Notice: Subject to any disclaimer, the term of this patent is extended or adjusted under 35 U.S.C. 154(b) by 80 days.

(21) Appl. No.: 10/144,629

(22) Filed: May 13, 2002

(65) Prior Publication Data

US 2002/0166276 A1 Nov. 14, 2002

Related U.S. Application Data

(60) Provisional application No. 60/290,449, filed on May 11, 2001.

(51) Int. Cl.[7] ..... G09F 3/20
(52) U.S. Cl. ..... 40/649; 40/654.01
(58) Field of Search ..... 651/40

(56) References Cited

U.S. PATENT DOCUMENTS 1,575,949 A * 3/1926 Thorn ..... 40/651
3,555,712 A * 1/1971 Yargeau ..... 40/649
3,824,720 A 7/1974 Langwell
4,483,502 A 11/1984 Fast
4,713,899 A 12/1987 Fast
5,344,250 A 9/1994 Kringel et al.
5,419,066 A * 5/1995 Harnois et al. ..... 40/649 X
5,502,911 A * 4/1996 Watts et al.
6,070,744 A 6/2000 Levinson et al.
6,202,334 B1 3/2001 Reynolds et al.
6,347,471 B1 * 2/2002 Mirza ..... 40/661.08 X

* cited by examiner

*Primary Examiner*—Joanne Silbermann
(74) *Attorney, Agent, or Firm*—Gardner Groff, P.C.

(57) ABSTRACT

A sheet having a first face panel and a second backing panel that form a generally flat pocket for receiving a card with information related to an object, and having a third panel for mounting to a shelf. First and second apertures are defined through the first and second panels in alignment, and a fastener extends through the first and second apertures. The fastener extends through an aperture in the object to secure and suspend the object from the display, and the fastener extends through an aperture in the card to secure the card in the pocket.

4 Claims, 8 Drawing Sheets

DISPLAY DEVICE FOR AN OBJECT

CROSS-REFERENCE TO RELATED APPLICATION

This application claims the priority benefit of U.S. Provisional Patent Application Ser. No. 60/290,449, filed May 11, 2001, the entire scope and content of which is hereby incorporated herein by reference.

TECHNICAL FIELD

The present invention relates generally to devices for displaying an object and, more particularly, to a display device for holding and displaying a product and related product information.

BACKGROUND OF THE INVENTION

When shopping for some products, consumers like to be able to look at and feel the product before buying it. Such products include, for example, diapers, underwear, tee shirts, sox, and so forth, whose softness, texture, and/or durability matters when deciding which product to buy. But many times these products are packaged, for example, in plastic bags, paper boxes, etc., so that they cannot be touched or sometimes even seen. So buyers sometimes get their purchases home, unwrap them, and find out they wish they had bought the other brand. Or sometimes consumers will pick up a product of the shelf and open it to touch and feel it. But then the retailer has to return the product to the manufacturer because it has been opened, which is wasteful and results in higher prices for everyone.

Accordingly, it can be seen that there is a need for a display device for holding a product so that consumers can see, touch, and feel it before buying it. In addition, it would be advantageous for such a display device to permit the consumers to get more information about the product while they are inspecting the displayed product. It is to the provision of a display device meeting these and other needs that the present invention is primarily directed.

SUMMARY OF THE INVENTION

The present invention includes a display for holding a product or other object and a card with the features and benefits of the product or with other information relating to the product. The display holds the product so that consumers can see, touch, and feel it when making their purchasing decision. Thus, the display is well suited for use with products such as diapers, underwear, tee shirts, sox, and other products whose touch and feel might be a factor in considering purchasing the product. But the product is secured in place so that after being evaluated by the consumer it cannot then be removed or placed elsewhere. And the display holds the card so that the consumers can read about and/or see graphics depicting the advantages of the product while they are touching it. In this way, the display enables consumers to make better-informed purchasing decisions.

Briefly described, the display includes a sheet of generally rigid material having a first face panel and a second backing panel. The second panel extends from, is folded back over, and is adjacent to the first panel, thereby forming a flat pocket for the card. Also, the first panel has one or more first apertures and the second panel has one or more second apertures aligned with the first apertures. Additionally, one or more fasteners extend through the first and second apertures to secure the object to the "display".

In a first exemplary embodiment, the display is adapted for use with a card having one or more apertures in it, and the fastener can be extended through the card aperture to secure the card in the pocket while securing the object to the display. Also, the sheet includes a third panel for mounting to a shelf.

The third panel is generally horizontal and has a mounting segment for mounting to a top surface of the shelf and a spacer segment between the second panel and the mounting segment. In this way, the display is spaced in front of the shelf so that the product is more likely to attract the consumer's attention and so that the fastener can be easily inserted and removed from the display.

In a second exemplary embodiment, the third panel has a generally vertical mounting segment for mounting to a front edge of the shelf and a generally horizontal spacer segment between the second panel and the mounting segment. This spacer segment configuration provides similar benefits to that of the first exemplary embodiment.

In a third exemplary embodiment, the first and second panels have generally vertical upper segments and forwardly angled lower segments, and the first and second apertures are in the forwardly angled lower segments. Because the lower segments are angled forward, the second panel does not need to be spaced from the shelf.

In a fourth exemplary embodiment, the first panel and the second panel are angled, and the third panel has an angled riser segment and a mounting segment that is generally horizontal for mounting to a top surface of the shelf. The angled riser segment and the mounting segment form an inverted V-shape so that a top of the first panel is elevated above the shelf when the display is mounted to the shelf. In this way, the display is more vertically centered on the shelf and the mounting segment is somewhat concealed.

In a fifth exemplary embodiment, the first panel has four segments and the second panel has four segments that are parallel to the corresponding first panel segments and configured in a triangular shape. The front end segments form a pocket for receiving the card and one of the rear end segments defines a mounting segment for mounting to the shelf. Also, the segments form a triangular shape for conforming to a generally vertical front edge of the shelf such as warehouse shelving.

In a sixth exemplary embodiment, the segments form a triangular shape for conforming to an angled front edge of the shelf such as channel strip gondola shelving. Also, the fastener is mounted to one of the segments instead of being inserted through apertures in the display.

In addition, the present invention includes a method for displaying an object and information relating to the object. The method includes providing a display such as any of those described above that have a pocket, aligned apertures through the pocket, and fasteners through the apertures. The method further includes providing a card with the information relating to the object marked thereon. To carry out the method, an aperture is formed in the card, the card is inserted into the pocket, and the card aperture is aligned with the display apertures. Also, an aperture is formed in the object, the object is positioned adjacent to the display first panel, and the object aperture is aligned with the display apertures. Then the fastener is inserted through the object aperture, the card aperture, and the first and second display apertures to secure and suspend the object from the display and to secure the card in the pocket.

Of course, two or more apertures may be put in the card and the object, and two or more sets of aligned apertures may be put in the display. Also, if the object is packaged, then it may be removed from its packaging or a part of the packaging may be removed to expose a part of the object where consumers can touch.

These and other objects, features, and advantages of the present invention will become more apparent upon reading the following description in conjunction with the accompanying drawing figures.

BRIEF DESCRIPTION OF THE DRAWING FIGURES

DETAILED DESCRIPTION OF THE EXEMPLARY EMBODIMENTS

Figure 1:
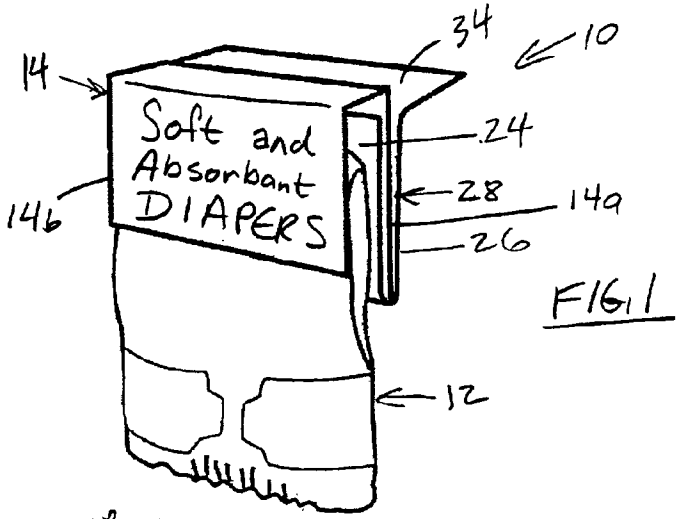
FIG. 1 is a perspective view of a display according to a first exemplary embodiment of the present invention, showing the display in use with a diaper product and a product information card.
Figure 2:
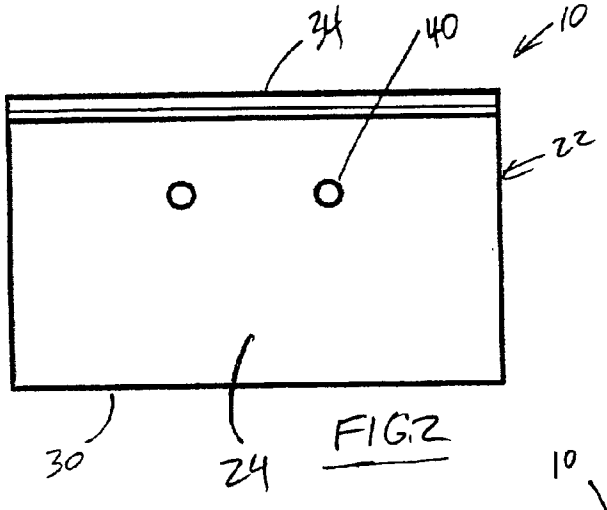
FIG. 2 is a front elevation view of the display of FIG. 1, showing the first face panel and its apertures.
Figure 3:
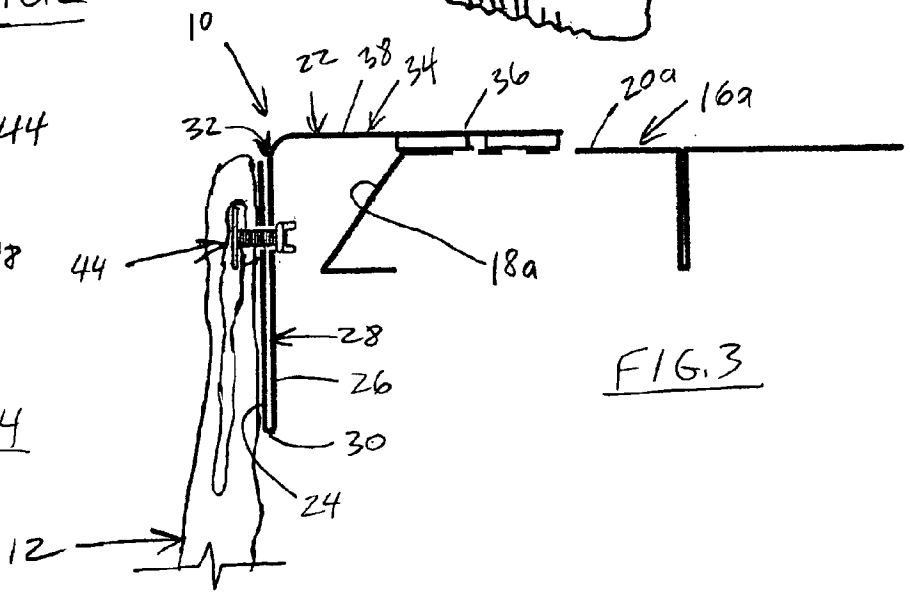
FIG. 3 is a side elevation view of the display of FIG. 1, showing the third mounting panel having a spacer segment and a mounting segment mounted to a shelf with an angled front edge.
Figure 4:
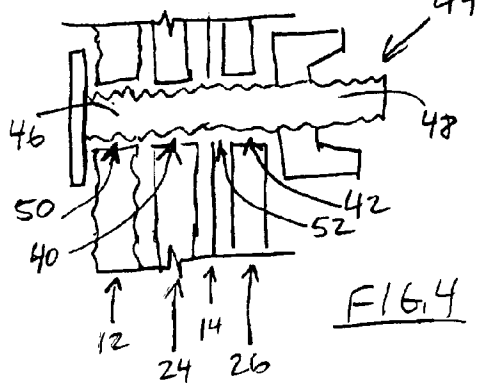
FIG. 4 is a side detail of the display of FIG. 3, showing the fasteners securing the product and the card in place.
Figure 5:
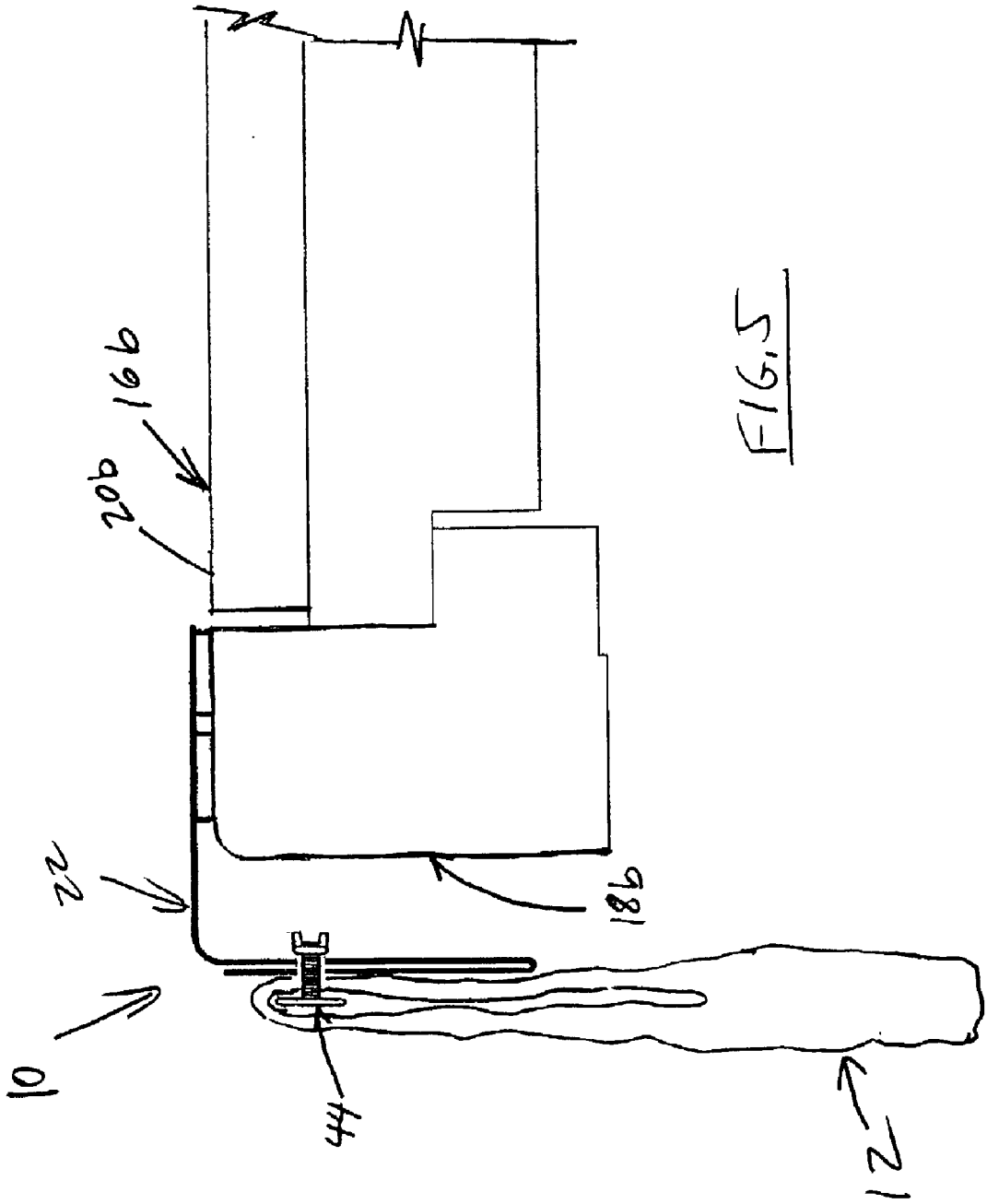
FIG. 5 is a side elevation view of the display of FIG. 1, showing the mounting segment mounted to a shelf with a vertical front edge.

Referring now to the drawing figures, wherein like reference numerals represent like parts throughout the several views, FIGS. 1–5 show a first exemplary embodiment of the present invention, generally referred to as the display 10. The display 10 holds a commercial product 12 or other object so that consumers can see, touch, and feel it when making their purchasing decision, without removing one of the products from its packaging. So before display, the product 12 can be unpackaged or have a portion of its packaging removed to expose a portion of the product where consumers can see and touch the object. Thus, the display 10 is well suited for use with products 12 such as diapers (as shown in the figures), underwear, tee shirts, sox, and other products whose appearance and feel might be a factor in deciding whether to purchase the product.

Additionally, the display 10 holds a card 14 with information relating to the product 12 printed or otherwise marked on or attached to it. For example, the card 14 may include features and benefits of the product 12 listed on it, illustrations, photographs, or graphics of the product depicted on it, coupons or discounts, information about the manufacturer, or other information relating to the product. In this way, the display 10 holds the card 14 so that the consumers can read about and/or see the graphics about the product 12 while they are touching it.

The card 14 can be provided by a sheet of most any type of material, and not just conventional cards. Also, the card 14 can be sized with all of it fitting within the pocket or with some of it extending out of the pocket. For example, the card 14 can be folded into a base 14*a* and a flap 14*b*, with the base inserted into the pocket 28 and the flap hanging down over the first panel 24 and the product 12. In this way, the flap 14*b* can have information on its front and back, and consumers can lift the flap to get the additional information as desired. Also, the product 12 is somewhat protected from dirt and dust by the flap 14*b*.

Accordingly, the display 10 permits consumers to make better-informed purchasing decisions by inspecting and learning about the product before deciding to purchase it. But the product 12 is secured in place so that after or while being looked at and felt by the consumer it cannot be removed from the display 10. Also, the card 14 is secured in place so that it can not be intentionally or accidentally removed from the display 10. And because consumers can get all this information so easily, they are less likely to pick up one of the products on the shelf and open its package to look at and feel it.

The display 10 can be mounted to a shelf such as channel strip gondola shelf 16*a* having an angled front edge 18*a* and a top surface 20*a* (see FIG. 3), as is commonly used in grocery stores, drug stores, and elsewhere. The display 10 can alternatively be mounted to a shelf such a warehouse shelf 16*b* having a generally vertical front edge 18*b* and a top surface 20*b* (see FIG. 5), as is commonly used in warehouses and elsewhere. For convenience, the shelves 16*a* and 16*b* are referred to herein collectively as the shelf 16, the front edges 18*a* and 18*b* are referred to herein collectively as the front edges 18, and the top surfaces 20*a* and 20*b* are referred to herein collectively as the top surfaces 20. It will be understood that the display 10 can alternatively be used with other types of shelves, including cabinets, tables, desks, and other structures having a top surface and an edge.

In this way, the display 10 can be used with most any type of shelving system, providing great convenience to stores and other users of the display. Because the display 10 extends from the front of the shelf 16, it does not take up shelf space and reduce the number of products on the shelf. But the display 10 protrudes only a minimal distance from the shelf 16 into the aisle, so consumers will not bump into it.

Turning now to the details of the display 10, it includes a sheet 22 of generally rigid material such as acrylic. The display 10 can be easily made by bending and folding the acrylic sheet by conventional fabrication techniques. Alternatively, another material such as a plastic, metal, laminated paperboard, or composite can be used. A generally transparent material is preferable in some applications to permit viewing the card 14, though opaque materials can be used as desired.

The sheet 22 has a first face panel 24 and a second backing panel 26 that extends from and is folded back over adjacent to the first panel to form a generally flat pocket 28. The pocket 28 has a closed bottom 30 and an open top 32 for receiving the card 14 in the pocket. Alternatively, the sheet can be formed with the top closed and the bottom open (with the card secured therein as described below), or with both the top and the bottom closed and the sides open for access to insert the card 14.

The first panel 24 and the second panel 26 are generally vertical and thus perpendicular to the shelf 16 and the floor for ease of viewing by typical consumers. Alternatively, the first panel 24 and the second panel 26 can be angled to face upward or downward as desired depending on the height of the shelf 16.

The sheet 22 also includes a third mounting panel 34 that extends from the second panel 26 for mounting to the shelf 16. The third panel 34 is generally horizontal and thus parallel to the top surface 16 of the shelf 16, though alternatively it could be varied slightly from horizontal. Those skilled in the art will understand that many other mounting segment configurations can be included in the present invention, some of which are described in detail herein.

The third panel 34 has a mounting segment 36 for mounting to the top surface 16 of the shelf 16 and a spacer segment 38 between the second panel 26 and the mounting segment 36. The mounting segment 36 can be provided with various mountings for mounting it to the shelf 16, such as hook-and-look fasteners, magnets, or holes in it and screws, pins, or other fasteners that are inserted through the holes and into holes in the top of the shelf. The spacer segment 38 is configured to permit the display 10 to be mounted to a shelf 16*a* with an angled front edge 18*a* or to a shelf 16*b* with a generally vertical front edge 18*b*.

Additionally, the display 10 includes at least one first aperture 40 in the first panel 24 and at least one second aperture 42 in the second panel 26 and aligned with the first aperture 40. The apertures 40 and 42 may be provided by circular holes, slots, or other regular or irregular-shaped openings. Although two sets of apertures 40 and 42 are shown, it will be understood that another number of sets of apertures can be provided as desired.

Furthermore, at least one fastener 44 is provided for extending through each set of apertures 40 and 42. The fasteners 44 can be provided by conventional viking clips, screws, bolts, pins, clips, rivets, hooks, eyelets, or other conventional fasteners. The fasteners 44 each have a front end 46 that extends from the first panel 24 and a rear end 48 that extends from the second panel 26. The spacer segment 34 has a length that is the same as or greater than the length of the rear end 48 of the fastener 44. In this way, the display 10 is spaced in front of the shelf 16 so that the product 12 is more likely to attract the consumer's attention and so that the fastener 44 can be easily inserted and removed from the display. Also, the fastener 44 can be positioned contacting and abutting the shelf 16 to provide a bracing effect to help support the weight of the product 12.

Moreover, the product 12 has at least one aperture 50 in it and the card 14 has at least one aperture 52 in it. With these apertures 50 and 52, the fastener 44 can be extended through the object aperture 50 to support the object 12 in suspension and extended through the card aperture 52 to secure the card 14 in the pocket 28. Alternatively, the card 14 can be sized so that it rests on the fasteners 44 extending through the display 10.

Figure 6:
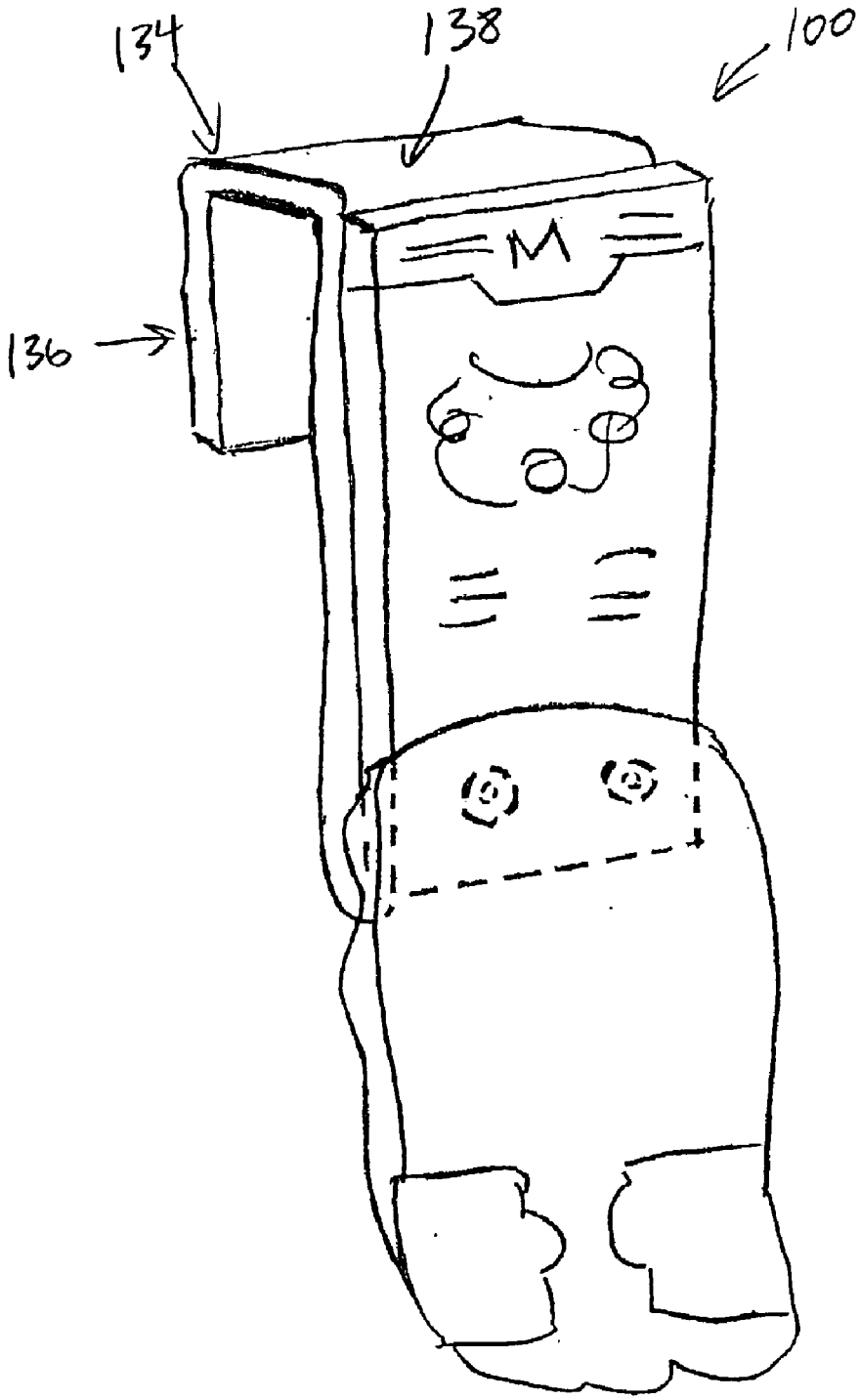
FIG. 6 is a perspective view of a display according to a second exemplary embodiment, showing the third mounting panel having a vertical mounting segment and a horizontal spacer segment.

Referring to FIG. 6, there is shown a second exemplary embodiment of the present invention, referred to generally as the display 100, that is similar to the first embodiment. In this embodiment, the display 100 has a third panel 134 with a generally vertical mounting segment 136 for mounting to the front edge of the shelf and a generally horizontal spacer segment 138 between the second panel 126 and the mounting segment 136. Alternatively, the mounting segment 136 can be angled from vertical to conform to angled front shelves. With this spacer segment 138, the display 10 is spaced in front of the shelf 16 to provide benefits similar to the first embodiment.

Figure 7:
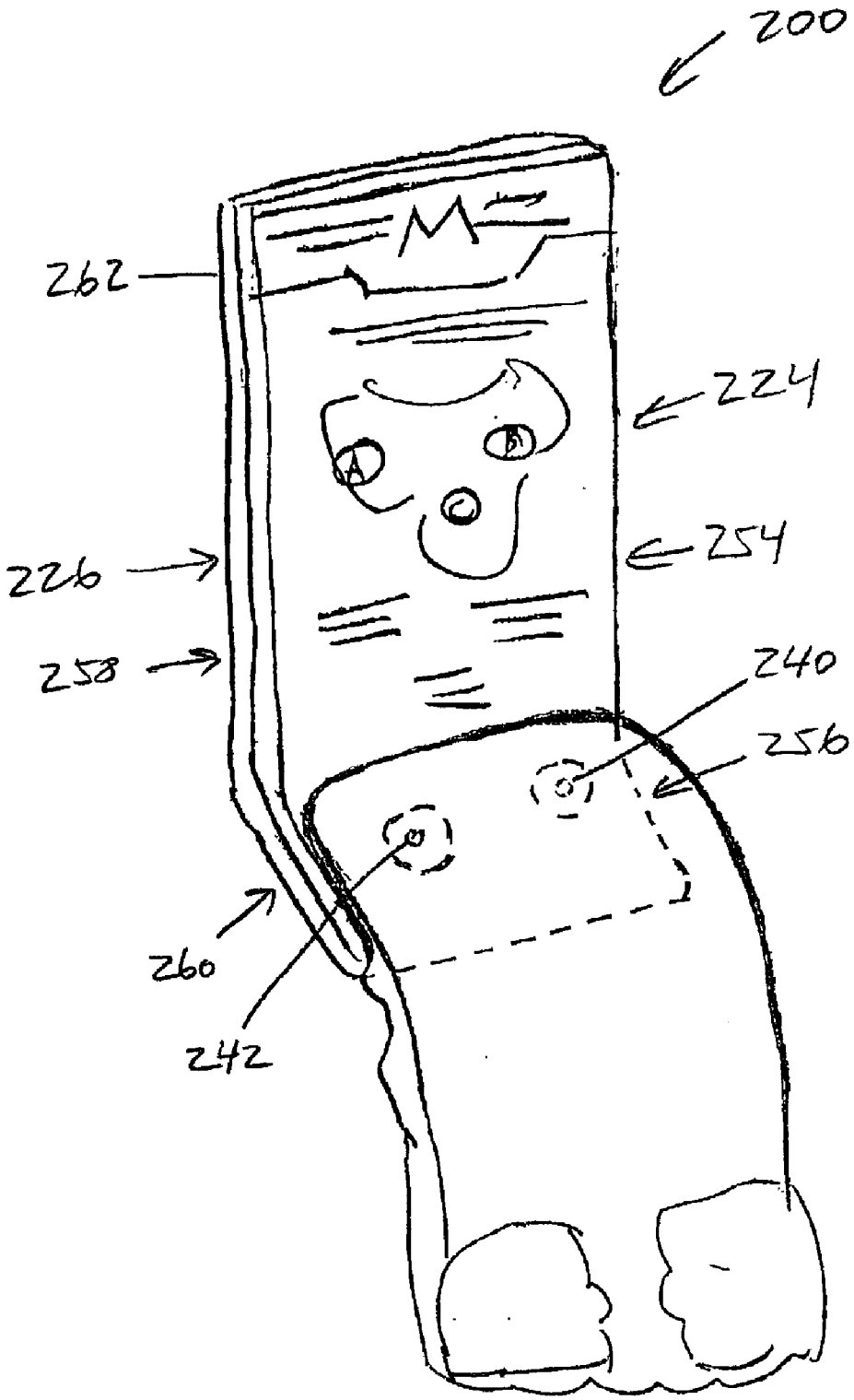
FIG. 7 is a perspective view of a display according to a third exemplary embodiment, showing forwardly angled lower segments and the mounting segment provided on the second panel for mounting to the front edge of the shelf.

Referring to FIG. 7, there is shown a third exemplary embodiment of the present invention, referred to generally as the display 200, that is similar to the first embodiment. In this embodiment, the first panel 224 has a generally vertical upper segment 254 and a lower segment 256 that is angled with respect to the first panel upper segment. Similarly, the second panel 226 has a generally vertical upper segment 258 and a lower segment 260 that is angled with respect to the second panel upper segment. Also, instead of on a third mounting panel, the mounting segment is provided at a top 262 of the second panel upper segment 258, for mounting to the front edge of the shelf. Alternatively, the top mounting segment 262 can be angled from vertical to conform to angled front shelves, instead of being vertical. Additionally, the first aperture 240 is in the first panel angled lower segment 256 and the second aperture 242 is in the second panel angled lower segment 260. In this arrangement, because the lower segments 256 and 260 are angled forward, the second panel 226 does not need to be spaced from the shelf.

Figure 9:
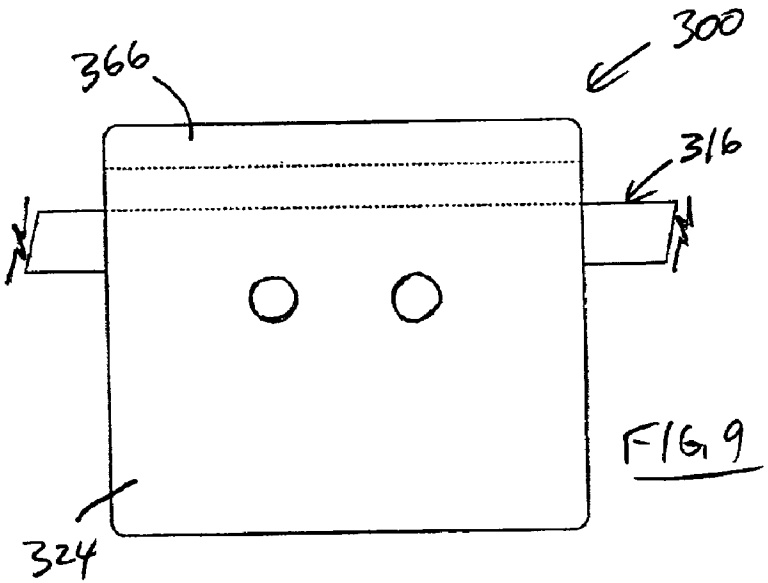
FIG. 9 is a front elevation view of the display of FIG. 8.
Figure 10:
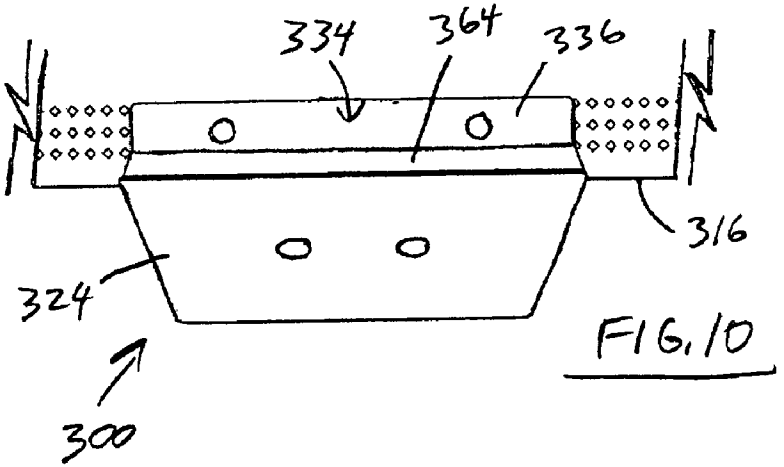
FIG. 10 is a plan view of the display of FIG. 8.
Figure 8:
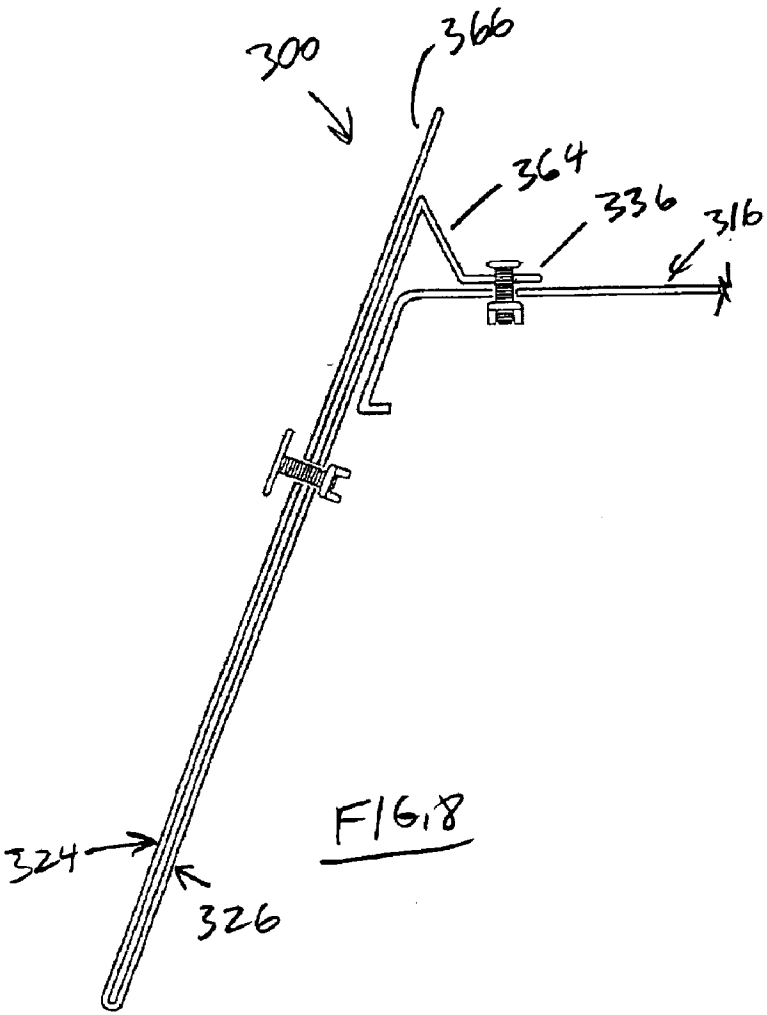
FIG. 8 is a side elevation view of a display according to a fourth exemplary embodiment, showing angled first and second panels and the third panel including a riser segment for elevating the display above the shelf.

Referring to FIGS. 8–10, there is shown a fourth exemplary embodiment of the present invention, referred to generally as the display 300, that is similar to the first embodiment. In this embodiment, the first panel 324 and the second panel 326 are angled from vertical. The third panel 334 has a mounting segment 336 that is generally horizontal for mounting to the top surface of the shelf 16 and a riser segment 364 that extends between the second panel 326 and the mounting segment 336. The riser segment 364 is angled from the mounting segment 336 so that the riser segment and the second panel 326 form an inverted V-shape. In this way, the top 366 of the first panel 324 is elevated above the shelf 316 when the display 300 is mounted to the shelf, so that the display is more vertically centered on the shelf and the shelf mounting is at least somewhat concealed.

Figure 11:
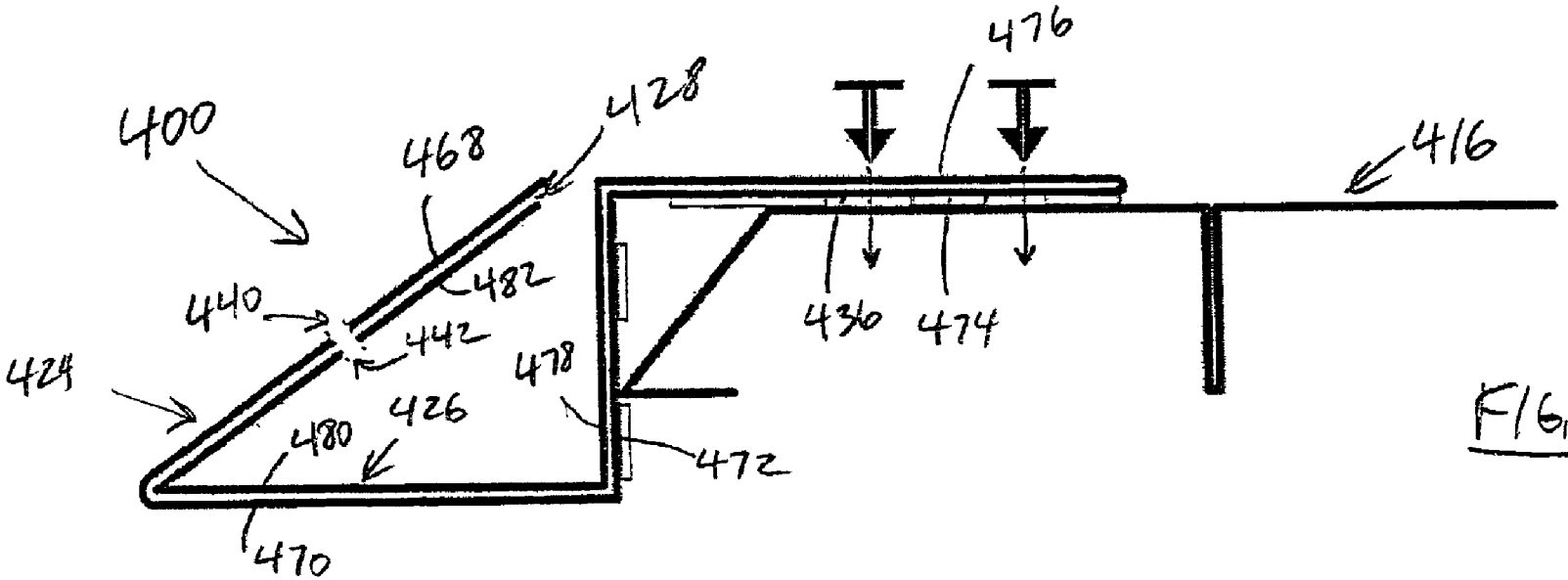
FIG. 11 is a side elevation view of a display according to a fifth exemplary embodiment, showing the panel forming a triangular shape.

Referring to FIG. 11, there is shown a fifth exemplary embodiment of the present invention, referred to generally as the display 400, that is similar to the first embodiment. In this embodiment, the first panel 424 includes a first segment 468, a second segment 470 extending at an angle from the first segment, a third segment 472 extending at an angle from the second segment, and a fourth segment 474 extending at an angle from the third segment. The second panel 426 includes a fifth segment 476 extending at an angle from the fourth segment 474 of the first panel 424, a sixth segment 478 extending at an angle from the fifth segment, a seventh segment 480 extending at an angle from the sixth segment, and an eighth segment 482 extending at an angle from the seventh segment. The first segment 468 and the eighth segment 482 are parallel, the second segment 470 and the seventh segment 480 are parallel, the third segment 472 and the sixth segment 478 are parallel, and the fourth segment 474 and the fifth segment 476 are parallel. Also, the first segment 468 and the eighth segment 482, the second segment 470 and the seventh segment 480, and the third segment 472 and the sixth segment 478 are configured in a triangular shape.

In addition, the fourth segment 474 and the fifth segment 476 are generally horizontal, with the fourth segment including the mounting segment 436 adapted for mounting to the shelf 416. Also, the first segment 468 and the eighth segment 482 form the pocket 428 for receiving the card. Additionally, apertures 440 and 442 are provided for receiving the fastener to hold the product and the card in place.

Figures 12, 12A:
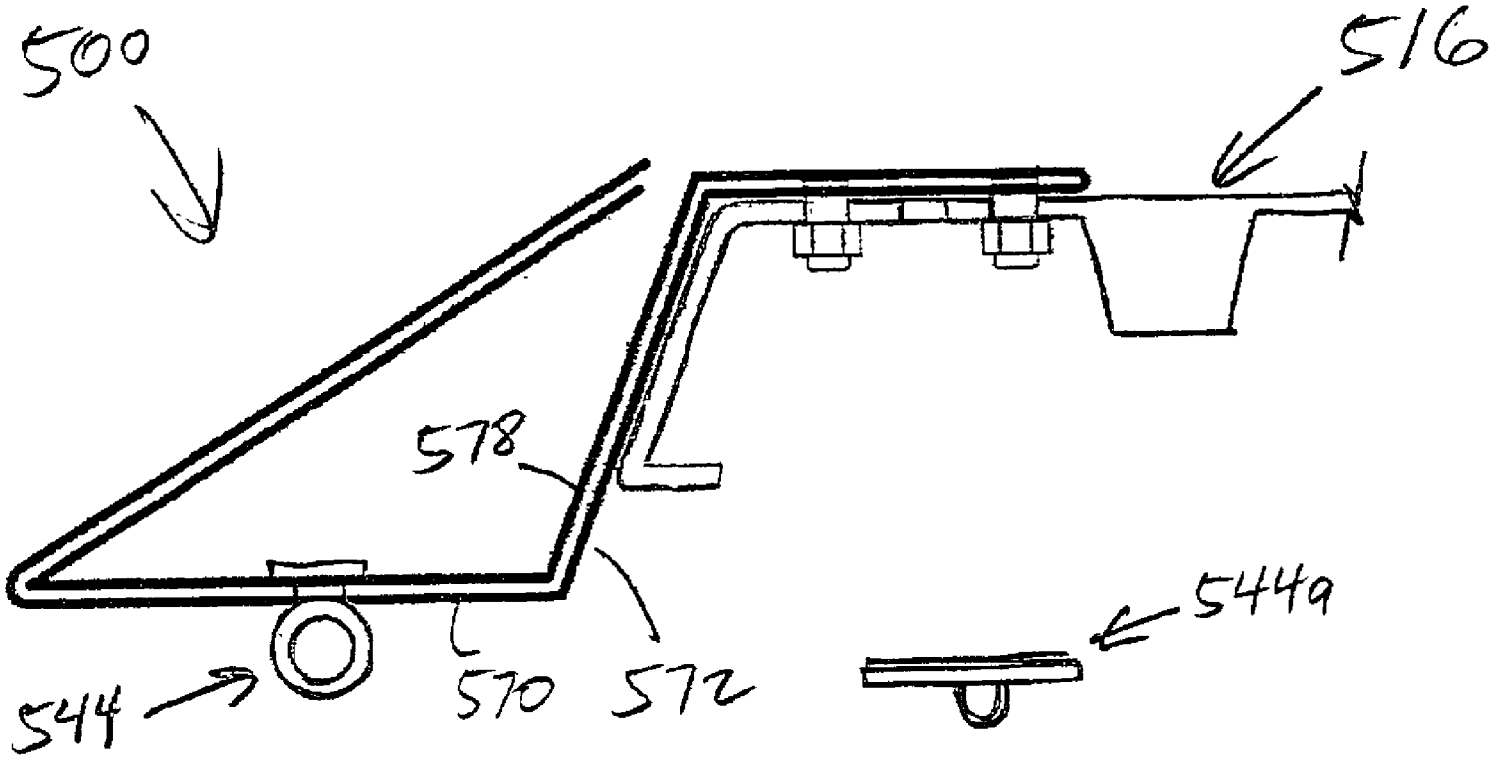
FIG. 12 is a side elevation view of a display according to a sixth exemplary embodiment, showing the panel forming a triangular shape conforming to the angled front edge of the shelf.
FIG. 12A is a detail of an alternative fastener for use with the display of FIG. 12.

Referring to FIG. 12, there is shown a sixth exemplary embodiment of the present invention, referred to generally as the display 500, that is similar to the fifth embodiment. In this embodiment, the third segment 572 and the sixth segment 578 are angled to conform to the angled front edge of the shelf 516. Additionally, the fastener 544 is coupled to the second segment 570 and extends downwardly to support the object in suspension. In this embodiment, the fastener can be extended though the apertures in the display (as shown in FIG. 12), or it can be mounted to the surface of one of the display (as shown in FIG. 12A).

Figure 13:
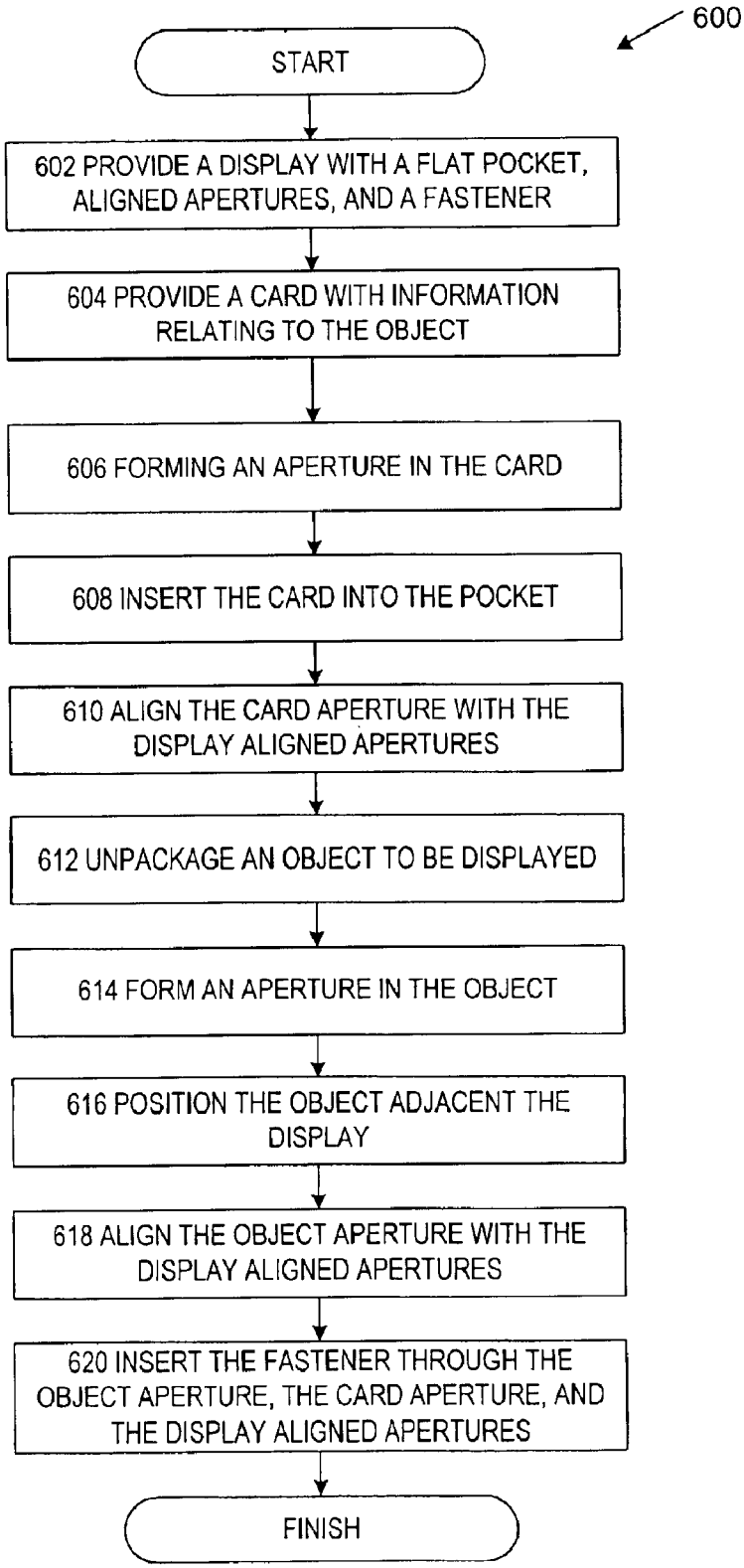
FIG. 13 is a flow diagram of a method for displaying a product and information about the product.

Referring now to FIG. 13, the present invention additionally includes a method 600 for displaying a product and information relating to the product. The method 600 is well suited for used with the type of products described above. The method 600 includes at step 602 providing a display such as any of those described above that have a flat pocket, aligned apertures through the pocket, and fasteners through the apertures. The method 600 further includes at step 604 providing a card such as that described above with the information relating to the product marked thereon.

Then, at step 606, at least one aperture is formed in the card. The aperture can be formed by cutting, punching, or another conventional technique. It will be understood that the card may be provided with the aperture during manufacture or printing or the aperture may be made on-site in the store. The number and position of the card apertures are preferably selected to match the number and position of aperture sets in the display. Next, at step 608 the card is inserted into the pocket and, at step 610, positioned so that the card aperture aligns with the display apertures.

At step 612, if the product to be displayed comes packaged, then it is unpackaged. Thus, the product can be removed from its packaging, or at least a portion of the packaging can be removed to expose at least a portion of the product, so that consumers can see, touch, and feel the product before purchasing one of them.

Then, at step 614, at least one aperture is formed in the product. The aperture can be formed by cutting, punching, or another conventional technique. It will be understood that the product may be provided with the aperture during manufacture or packaging or the aperture may be made on-site in the store. The number and position of the product apertures are preferably selected to match the number and position of aperture sets in the display. Next, at step 616 the product is positioned against the display and, at step 618, oriented so that the product aperture aligns with the display apertures.

Next, at step 620, the fastener is inserted through the product aperture, the card aperture, and the display apertures. This step is repeated for each fastener and set of apertures, as appropriate. In this way, the product is secured to and suspended from the display, and the card is secured in the pocket.

Accordingly, the display permits consumers to see, touch, and feel a product, while learning about its features and benefits from the card, before deciding to buy it. So consumers know what they are getting without having to pick up a product from the shelf and open its package to inspect it.

It will be understood that the method described herein is not intended to be limited to the particular sequence of steps presented, but can be accomplished in another order. It will be further understood that the various features described in the various embodiments can be provided in a number of different combinations for different applications.

While the invention has been shown and described in preferred forms, it will be apparent to those skilled in the art that many modifications, additions, and deletions can be made therein without departing from the spirit and scope of the invention as set forth in the following claims.

What is claimed is:

1. A promotional fixture for mounting to a shelf, comprising:

an object for display other than a flat card, the object defining at least one aperture and having at least a portion that is unpackaged and exposed where consumers can touch the object;

a flat card that is a separate structure from the object, the card defining at least one aperture, wherein the card is folded to form a base and a flap; and a display for holding the object and the card;

the display including a one-piece sheet of generally rigid material having a first panel, a second panel extending from, folded back over, and adjacent to the first panel to form a pocket with a closed bottom and an open top and sides, wherein the base of the card is inserted into the pocket and the flap of the card extends down over the front panel, and a third panel extending from the second panel and adapted for mounting to the shelf, wherein the first panel and the second panel have generally the same size and are made of the same material, wherein the first panel and the second panel are generally vertical, and the third panel is generally horizontal and has a mounting segment for mounting to a top surface of the shelf and a spacer segment disposed between the second panel and the mounting segment, wherein the spacer segment is configured to permit the display to be mounted to a shelf with a front edge that is generally vertical or that is angled from vertical;

at least one first aperture defined through the first panel and at least one second aperture defined through the second panel and aligned with the first aperture; and at least one fastener extending through the first aperture and the second aperture, the fastener having a front end and a rear end, the front end extending from the first panel and the rear end extending from the second panel with the fastener extended through the object aperture to support the object in suspension and at the same time extended through the card aperture to secure the card in the pocket, wherein the flap of the card extends down over and conceals the fastener, and wherein the spacer segment has a length that is the same as or greater then the length of the rear end of the fastener.

2. The fixture of claim 1, wherein the first panel and the second panel are generally rectangular.

3. The fixture of claim 1, wherein the object is a diaper.

4. The fixture of claim 1, wherein the card includes information relating to the object.

* * * * *